US009320083B2

(12) United States Patent
Lollar

(10) Patent No.: US 9,320,083 B2
(45) **Date of Patent: *Apr. 19, 2016**

(54) MULTIPLE STAGE OPEN COIL ELECTRIC RESISTANCE HEATER WITH BALANCED COIL POWER ARRANGEMENT AND METHOD OF USE

(71) Applicant: James Patrick Lollar, Cookeville, TN (US)

(72) Inventor: James Patrick Lollar, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 320 days.

This patent is subject to a terminal disclaimer.

(21) Appl. No.: 13/755,488

(22) Filed: Jan. 31, 2013

(65) Prior Publication Data

US 2013/0277358 A1 Oct. 24, 2013

Related U.S. Application Data

(60) Provisional application No. 61/625,752, filed on Apr. 18, 2012.

(51) Int. Cl.

| | |
|---|---|
| ***H05B 3/06*** | (2006.01) |
| ***H05B 1/00*** | (2006.01) |
| ***F24H 3/04*** | (2006.01) |
| ***H05B 3/32*** | (2006.01) |
| ***F24H 9/18*** | (2006.01) |

(52) U.S. Cl.

CPC ..... *H05B 1/00* (2013.01); *F24H 3/0405* (2013.01); *F24H 9/1863* (2013.01); *H05B 3/32* (2013.01)

(58) Field of Classification Search

CPC ..... H05B 3/06; H05B 3/16; H05B 3/32; H05B 1/00; F24H 3/0405; F24H 9/1818; F24H 9/1863

See application file for complete search history.

(56) References Cited

U.S. PATENT DOCUMENTS

| | | | | |
|---|---|---|---|---|
| 5,324,919 | A | 6/1994 | Howard et al. | |
| 5,329,098 | A | 7/1994 | Howard et al. | |
| 5,585,597 | A | 12/1996 | Faigle | |
| 5,895,597 | A | 4/1999 | Sherrill | |
| 5,925,273 | A | 7/1999 | Sherrill | |
| 7,075,043 | B2 | 7/2006 | Howard et al. | |
| 7,154,072 | B2 | 12/2006 | Sherrill et al. | |
| 7,947,932 | B2 | 5/2011 | Sherrill et al. | |
| 8,278,605 | B2 * | 10/2012 | Lollar | 219/532 |
| 2006/0000824 | A1 | 1/2006 | Howard et al. | |
| 2009/0139984 | A1 | 6/2009 | Sherrill et al. | |

FOREIGN PATENT DOCUMENTS

| | | |
|---|---|---|
| CN | 101636003 | 1/2010 |

* cited by examiner

*Primary Examiner* — Shawntina Fuqua
(74) *Attorney, Agent, or Firm* — Clark & Brody

(57) ABSTRACT

An open coil electrical resistance heater subassembly for use in a heater has a support plate dividing the heater into at least two portions. At least two resistance wire coils are supported on the support plate using a plurality of insulators. Each insulator is configured to provide support to a portion of the resistance wire coil. The at least two resistance wire coils are arranged with respect to the support plate so that the coil power for each coil is distributed generally evenly between the top and bottom of the support plate and across the width of the support plate.

13 Claims, 13 Drawing Sheets

MULTIPLE STAGE OPEN COIL ELECTRIC RESISTANCE HEATER WITH BALANCED COIL POWER ARRANGEMENT AND METHOD OF USE

FIELD OF THE INVENTION

The present invention is directed to a multistage open coil electric resistance heater and method for use, and in particular, to a multistage heater configuration whereby the coil runs of each stage are arranged to provide a balanced power arrangement for the heater.

BACKGROUND ART

The use of a single resistance wire formed into a helical coil for use in electric resistance heating either for heating moving air, for radiant heating, or for convection heating is well known in the prior art. In one type of heater, the resistance coils are energized to heat air passing over the coils, the heated air then being directed in a particular manner for heating purposes. One application using such a heater is an electric clothes dryer.

Examples of open coil heaters are found in U.S. Pat. Nos. 5,329,098, 5,895,597, 5,925,273, 7,075,043, and 7,154,072, all owned by Tutco, Inc. of Cookeville, Tenn. Each of these patents is incorporated by reference in its entirety herein. One type of an open coil electric resistance heater is a two stage heater described in U.S. Pat. No. 7,075,043. A side view of this type of heater is shown in FIG. 1 and designated by the reference numeral 10. The heater 10 has two heater elements 10*a* and 10*b*, optimally for use in a clothes dryer. The elements 10*a* and 10*b* are supplied with electricity via terminals 12 extending from the terminal block 28. The heater elements 10*a*, 10*b* are supported by a support plate 14, which in turn supports a plurality of support insulators 16, typically made of ceramic material and which are well known in the art. The support insulators 16 support and isolate coiled portions of the elements, 10*a* and 10*b*, during operation of the heater.

The heater 10 includes opposing sidewalls (one shown as 6 in FIG. 1), wherein projections in the plate 14 extend through slots 20 in the sidewall 6 to allow the sidewalls to support the plate.

Each of the electric heater elements, 10*a* and 10*b*, is arranged in series of electrically continuous coils which are mounted on the plate 14 in a spaced-apart substantially parallel arrangement. Each heater assembly 10*a* and 10*b* is arranged substantially equally and oppositely on both sides of the plate. Crossover portions 22*a* and 22*b* of each heater element 10*a* and 10*b* are provided wherein each crossover links one coil of each of the elements mounted on one side of the plate 14 with another coil of the same element found on the other side of the plate.

Electricity is supplied to the heater assembly through the terminal block 28. The heater elements, 10*a* and 10*b*, are arranged so that the terminal connector portions or wire leads 32 and 34 which extend from an end 38 of each of the mounted coil sections to the terminal block are as short as possible. This aids in eliminating or reducing the need for supporting the connector portions. For the longer runs, the wire leads, 32 and 34, are partially enclosed with an insulating member 36. The insulating member 36 may be formed from any type of insulating material suitable for this purpose, e.g., a ceramic type. The insulating member is generally tubular in shape and rigid.

Another type of heater manufactured by Tutco, described in U.S. Pat. No. 7,947,932 (herein incorporated by reference) is an improvement over the heater shown in FIG. 1, in that the heater coils are parallel to air flow to minimize noise, prevent coil shadowing, and promote heat transfer from the heater coils to the air stream.

In the manufacture of appliances and equipment, especially clothes dryer manufacture, that require open coil electric heaters mounted in an air duct to heat air flowing through the duct, there is a constant need to provide an inexpensive method of making an electric heater having multiple stages of heat such that each stage provides some heat to each side of a support plate. In the prior art of open coil heaters having heater coils supported by ceramic insulators held in metal plates, one method of providing two stages of heat is to have one heater coil completely assembled on one side of the plate and the second coil on the opposite side, see U.S. Pat. No. 7,154,072. Upon energizing the first stage of heat, only the air on one side of the plate is heated making for a less than desirable heat distribution for the first heating stage.

Another method to improve heat distribution is to route the first stage coil so a portion of the heater coil is on one side of the support plate with the remainder of the coil routed on the opposite side, see U.S. Pat. No. 7,075,043 as one example. When these types of heaters are energized, heat is supplied to both sides of the duct during first stage heating. The second heat stage coils are similarly assembled to complement the first stage. This is an expensive design, as the ends of the heating element wire must be covered with special designed ceramic tubes or ceramic beads for electrical isolation to prevent grounding or reduction of electrical clearance, see the insulating members 36 in FIG. 1 as an example. Some designs use special designed ceramics to secure the heating element wire ends to prevent shorting, grounding, or the reduction in electrical clearance as the wires are routed to terminals. A well accepted method long used is to provide individual termination points located immediately adjacent to the element coil ends. This is an expensive alternative, as power connections must be routed to multiple locations. Also, it is often impractical as some terminal locations may require power connections be made in excessively hot areas resulting in rapid deterioration under heat. Therefore, there is a need in the industry for a two stage, open coil electric heater that is inexpensive and has an arrangement wherein the first stage of the heater heats both sides of the air duct with the second heating stage complementing the first.

In the prior art there are usually either threaded style bolts or studs or blade or quick connect termination for power connection. Crimp style terminals made of flat metal stock for blade or quick connect termination crimped around resistance ends is well known and is presently sold by the TYCO Corporation. In the prior art, it is a common practice when bolt and threaded stud terminal style terminals are required for power connection, that these terminals are attached to element wire ends by welding, crimping, or pressure connection.

Welding is usually done by first mechanically staking the element wire ends into a slot in the head of a terminal bolt and then welding the two together. Crimping heating element wire ends to threaded bolts is accomplished by creating a tube style opening in one end of threaded stud terminals, inserting the heating element wire ends into the tube openings, and then mechanically closing the tubes so as to create a crimp connection. The least desirable connections are pressure connections in which resistance wire coil ends are looped around terminal bolts or threaded studs, then "sandwiched" between a combination of washers and nuts, whereby subsequent tightening of the nuts create electrical connections.

In the prior art, heating elements made as above are routed and assembled into the intended positions with heavy termination bolts attached to the coil ends. When a common threaded terminal power connection is needed, as for two stage or other multiple stage heaters, common element wire ends share a common terminal bolt or stud. When this type of connection is needed, the various methods of connection described above are followed except two or more element wire ends are connected to the required common terminal. For the welded connection, two or more common element wire ends are placed in the terminal bolt slot, mechanically staked then welded as above. For the crimp method, two or more common element wire ends are placed into the tube opening and crimped as above. For the pressure connection method, two or more common element wire ends are looped together then "sandwiched" as above and the termination completed. Thus, for the three prior art termination methods above, at least one end each of heater wire elements of multiple stage heaters share at least one common terminal bolt.

A shortcoming with respect to the termination of heater coils is that when threaded stud or bolt style termination for heaters is needed, prior art methods require the heating element wire ends to be first secured to heavy and cumbersome terminal bolts; the coil and terminal bolt assembly routed and subsequently secured to the coil support insulators. If the pressure connection method is used so as to allow heating element coils to be first assembled into a heater and then to connect to terminal bolts or threaded studs, this process is cumbersome and labor intensive. Also pressure electrical connections depend too much on the manual skill and attention of the person performing the task unlike a mechanical connection and thus generally are avoided if possible.

When threaded style terminations are required in the industry, there is needed a means to first make secure electrical connections between resistance wire coil ends and lightweight, easy to handle connectors that can later be attached to the terminal bolts or threaded studs whichever is used.

Referring now to FIGS. 2-4, a prior art heater subassembly 20 is disclosed. FIGS. 2 and 3 depict a support plate 21 as part of the subassembly 20. The support plate 21 has a number of openings 23, which are sized to retain insulators 25. The insulators 25 are configured to connect to and support the coils 27 and 29.

The heater assembly 20 is a two stage heater, although more stages could be employed if so desired. The two stage heating is accomplished by the pair of resistance wire coils 27 and 29, with coil 27 representing the first stage and coil 29 representing the second stage.

Coil 27 has opposing terminal ends 31 and 33, with coil 29 having opposing terminal ends 35 and 37. Terminal ends 31 and 35 have a first type of terminal 39 attached thereto. Terminal ends 33 and 37 have a second type of terminal 41 attached thereto. Terminal 41 is a conventional blade end crimp style terminal whereby the end of the resistance wire is crimped to one end of the terminal. The other end is a flat configuration for connection as is well known in the art. Since these blade end crimp type terminals are well known, a further description is not necessary.

Referring now to FIGS. 5 and 7*a*-7*c*, the terminal 39 has a crimp end 43 and flat end 45. The crimp end 43 includes a pair of flanges 47, with a slot 49 between the flanges. The slot 49 receives the end of the coil wire and the flanges 47 are crimped to form a tight connection between the coil wire end and crimp end 45. The flat end 45 has an opening 51 that is sized to receive a stud or bolt or other elongated terminal member for connection. As described above, the terminal 39 can hold a bolt during assembly of the heater, with the bolt making the power connection once the heater is finally assembled. In the alternative, the terminal 39 can be used once the heater is completely assembled to attach to a particular stud or bolt using the necessary combination of washers and nuts for a secure connection. Thus, the manufacture of the heater assembly has maximum capability when assembling the heater to accommodate different modes of assembly.

Referring now to FIGS. 2-4 and 6, the arrangement of the coils 27 and 29 produces a termination zone 53 of the coils at one end of the support plate 21. Referring to FIG. 6, one end of a completed heater 60 is shown. The heater 60 includes the support plate 21, insulators 25, and coils 27 and 29, and their respective terminals 39 and 41. The heater 60 includes a circular duct 61 (other shaped ducts could be used) that is linked to the support plate using openings in the duct and the protrusions on the support plate as is well known in the art. The support plate 21 divides the duct into two halves, but other plates could be used to create more sectors of the heater.

The heater 60 supports a power terminal 63, which includes a ceramic bushing 65, with elongated members, e.g., threaded studs 67, extending from each end. One stud 67 attaches to both terminals 39 of the coils 27 and 29 using nut 69 and washer 71 (other combinations of washers and nuts or other fasteners may be employed). The other stud 67 is attached to power. The blade terminals 41 are attached to two other terminals 73 and 74 as conventionally done for these types of heaters. The terminals 73 and 74 have connectors 76 opposite the connection to terminals 41 to complete the circuitry of the heater.

By the configuration of the coils and formation of the termination zone 53, the terminations of the coil ends are located at one end of the heater. By positioning this end into upstream of the flow of air (where ambient air is introduced into the heater), the termination zone is on the cool side of the heater so that the effects of heated air on the terminations is minimized. Also, the terminals are all in the same location, which makes it easier to routing wiring and installing the heater.

The unique configuration of the coils is best seen in FIGS. 2-4 and 6. FIG. 2 represents the coils mounted to the side 75 of the support plate 21 (shown as the right side of the heater of FIG. 6) with FIG. 3 showing the coils mounted to the side 77 of the support plate 21 (shown as the left side of the heater of FIG. 6). For ease of understanding, the sides 75 and 77 each have a reference mark 79.

On side 77, it can be seen that there are two runs of the second stage coil 29 and one run of the first stage coil 27. On the opposite side 75, there is one full run and two half runs of the first stage coil 27, and two half runs of the coil 29. This configuration means that when the first stage heater is used, air passing on both sides 75 and 77 of the support plate is heated. Similarly, during a two stage heating, air passing on both sides is heated from both coils 27 and 29. If the runs on each side were considered to be in thirds, side 77 has two thirds of the coil 29 and one third of the coil 27, with side 75 having two thirds of the coil 27 and one third of the coil 29.

FIG. 4 shows the runs of coils in one drawing, which more clearly depicts the crossovers between the plate 21 and crossovers between coils 27 and 29 on each side of the plate 21. For side 77, coil 29 has both ends 80 of the coil portion (see FIG. 5 to more clearly see the end of the coil portion of the coil) terminate on side 77, with the two runs linked by crossing over at crossover portion 82 to the two half runs on side 75, which are linked by crossover portion 85.

Coil 27 has one coil end 78 terminate on side 77, with one crossover at crossover portion 84 to side 75 to another long run. The long run on side 75 links to one of the short runs on the same side by crossover portion 88, which in turn links to another short run on the same side by another crossover portion 90 so that the coil end terminates on side 75 at end 31 and terminal 39. While the free and uncoiled ends of the coils 27 and 29 could cross over the support plate 21 to attach to the desired terminal as shown in FIG. 6 for coil end 35, the ends of the coils themselves, i.e., 78 and 80, are separated by the support plate 21.

FIGS. 2 and 3 also show the runs of the coils 27 and 29 in a sinusoidal pattern or configuration. Each of the resistance wire coils 27 and 29 has a longitudinal axis generally parallel to an air flow path of the heater. At least a portion of the insulators 25 that support the coils 27 and 29 are offset from the path. These offset insulators 25 when combined with the insulators 25 on the path cause at least a portion of the resistance wire coil to have a sinusoidal shape as disclosed in application Ser. No. 11/987,542 noted above. It is this sinusoidal shape that provides advantages in terms of noise reduction, reduction of the shadowing problem, minimizing vibration resonancy, and better filling the volume of the heater for maximized heat transfer. While this sinusoidal shaped coil configuration is a preferred one, other coil configurations could be employed such as a straight configuration that has no sinusoidal pattern.

While the figures show a particular arrangement of terminals for each side of the plate 21, the terminals 39 and 41 could be switched if the terminations on the heater duct dictated such a switch.

It should be also understood that the configuration of the coils and creation of the termination zone 53 can be used with any types of terminals for the ends 31, 33, 35, and 37 of the coils. Also, while a two stage heater is shown, additional coils could be employed without departing from the equal partitioning of the coils for each stage on each side of the plate and maintaining termination at the cool or upstream end of the heater. The support plate 21 is typically metal in these types of heaters, but it can be any material capable of providing the desired strength and stability during the heater operation, a non-metallic material, composite and the like. The other heat components can also be made of any materials that are capable of functioning in the environment of open coil resistance heaters.

In use, the heater can be used to heat air passing over the coils in the known fashion. Also, the inventive terminal configuration allows the terminals 39 to be attached to one end of the coil prior to heater assembly or during an early stage of the assembly. The lightweight nature of the terminal avoids the problem encountered when heavy bolts have been used in the past. The use of the terminal 39 enables a secure termination at the power terminal to be easily made using nuts and washers.

While the prior art heaters provide adequate means to heat air or a fluid for a heating application, the heaters still are in need of improvement and the present invention responds to this need.

SUMMARY OF THE INVENTION

It is an object of the invention to provide an improved electrical resistance heater, including one has improved power distribution characteristics. The invention, in one aspect, is an improvement over an open coil electrical resistance heater subassembly that includes a support plate dividing the heater into at least two portions, at least two resistance wire coils, a plurality of insulators mounted to the support plate along a defined path, whereby each insulator is configured to provide support to a portion of the resistance wire coil, the at least two resistance wire coils being partitioned generally equally on each side of the support plate, the at least two resistance wire coils each having first and second coil ends with a lead extending from each of the first and second coil ends, wherein each of the first and second coil ends are located at one end of the support plate. The improvement of the invention comprises the at least two resistance wire coils being arranged with respect to the support plate so that the coil power for each coil is distributed generally evenly between the top and bottom of the support plate and across the width of the support plate.

Each of the at least two resistance wire coils can have a first terminal on one coil end and a second terminal on the other coil end, the first terminal further comprising a first end crimped to the one coil end and a second flat end with an opening sized to receive an elongated member of a terminal.

The at least two resistance wire coils can have their coil ends arranged on one side of the support plate with the other of the at least two resistance wire coils having one coil end on one side of the support plate and the other coil end on the other side of the support plate.

One of the at least two resistance wire coils can have its coil ends arranged on one side of the support plate with the other of the at least two resistance wire coils having one coil end on one side of the support plate and the other coil end on the other side of the support plate.

Another aspect of the invention is a heater having the inventive subassembly as a part thereof. The heater can include a heater duct having a power terminal mounted on one end thereof. At least one of the terminal ends is an elongated member extending from the power terminal, wherein each of the at least two resistance wire coils has a first terminal on one coil end and a second terminal on the other coil end, the first terminal further comprising a first end crimped to the one coil end and a second flat end with an opening sized receiving the elongated member of the power terminal for connection to power.

The open coil electrical resistance heater can comprise a duct of defined cross section, a support plate supported by the duct to divide the duct into two portions, at least two resistance wire coils adapted to connect to a power source for energizing of the heater, a plurality of insulators, each insulator mounted to the support plate to support portions of the resistance wire coils, wherein the at least two resistance wire coils are partitioned generally equally on either side of the support plate, each of the resistance wire coils having first and second coil ends with a lead extending from each of the first and second coil ends, wherein each of the first and second coil ends are arranged at one end of the heater, and further wherein the at least two resistance wire coils are arranged with respect to the support plate so that the coil power for each coil is distributed generally evenly between the top and bottom and across the width of the heater support plate.

The invention also includes an improvement in a method of method of heating air using an open coil electrical resistance heater. The improvement comprising using the multiple stage open coil electrical resistance heater described above for the heating. The subassembly or the heater can have at least two electrical resistance coils which comprise two runs, each of the two runs extending along a top surface of the support plate and generally the length of the support plate; and four runs, each of the four runs extending generally along a bottom surface of the support plate and generally about half the length of the support plate; or wherein the two runs are along the bottom surface and the four runs of each of the at least two electrical resistance wire coils are along the top surface. The crossovers for the two runs can be at the ends of the support plate where the coil portions of at least two electrical resistance wire coils terminate and/or crossovers for the four runs can be at a middle portion of the support plate.

DESCRIPTION OF THE PREFERRED EMBODIMENTS OF THE INVENTION

Figure 1:
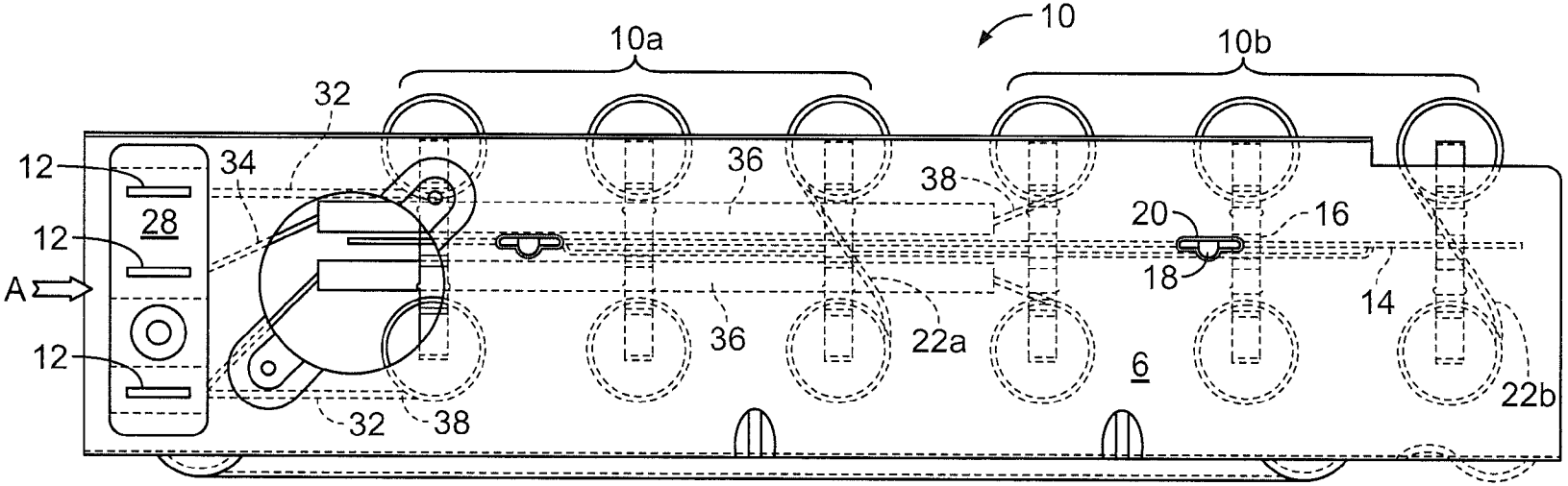
FIG. 1 (Prior Art)
FIG. 1 shows a side view of a prior art multi-stage open coil electric heater.

The invention relates to a duct mounted, open coil, multiple stage open coil electric heater using a metal support plate to retain insulators that in turn retain convolutions of a heating element coil. For two stage heaters, unlike the prior art heaters, such as disclosed in U.S. Pat. No. 8,278,605 (herein incorporated by reference), a new and unique coil routing provides the ability for the first stage of heat to provide heat to both sides of a metal support plate and additionally heat the air stream on each side of the duct, in a symmetrical fashion as related to top and bottom as well as right side to left side of the heater. This unique routing requires neither special ceramic insulators for insulating the heating element wire end nor carefully separated termination points.

The second stage of heat has an additional and new and unique routing that again provides a symmetrical configuration for both top to bottom and right side to left side symmetrical heating potential. All coil ends are located at one side of the heater plate making power lead routing as simple as possible.

Additionally and by utilizing a unique four (4) row configuration from right to left, symmetry can be maintained in both the top to bottom and right to left directions as well as providing for additional linear coil length, thus allowing much more usable space to be made available for the longer length coil runs. This added linear coil space allows the design to reduce the coil wire watt loading by providing enough area to utilize larger coil wire gauges which require additional length in order to fit in the available routing area. Additionally, the coil outside diameter has been reduced, allowing the designer the option of the four (4) row configuration by placing each row closer together in the right to left direction. Further and with the inventive design, the power termination leads can be located at the lowest temperature side of the heater, thereby minimizing deterioration by temperature.

The present invention is an improvement over the coil design shown in FIGS. 2-8B. While the prior art coil design mentioned above has a generally equal coil configuration between the top and the bottom of the heater, the power of the coils is not evenly distributed over the heater. The heater of the invention provides a uniform heat distribution, i.e., power, produced from top to bottom and from right side to left side). The inventive heater design also utilizes the length of the heater assembly to locate at least a portion of the heat in the front of the assembly and the remaining portion of heat in the back of the heater assembly.

More traditional heaters typically consist of one element or one stage, which produces all of the heat. However, if the heater is intended to produce two stages of heat and one element is to produce more or less than 50% of the heat and the other element to produce the remaining, one could located the higher or lower percent power element in the location where the airflow is less pre-heated (like the inlet side). This method can seek to reduce radiant heat and losses, thereby making the heater more efficient.

There are designs on the market which attempt to easily create an even heat distribution for a particular heater application. However, these heaters locate the heater sections as follows, one element in the front or inlet side of the heater and one located on the exit side of the heater. This design those does not produce a uniform heat along the length of the heater. That is, if one element of the two elements is used, only one end of the heater is employed for heating.

The heater of the invention specifically avoids this problem with its even heat distribution between top and bottom as well as across the width and along the length of the heater.

Figure 2:
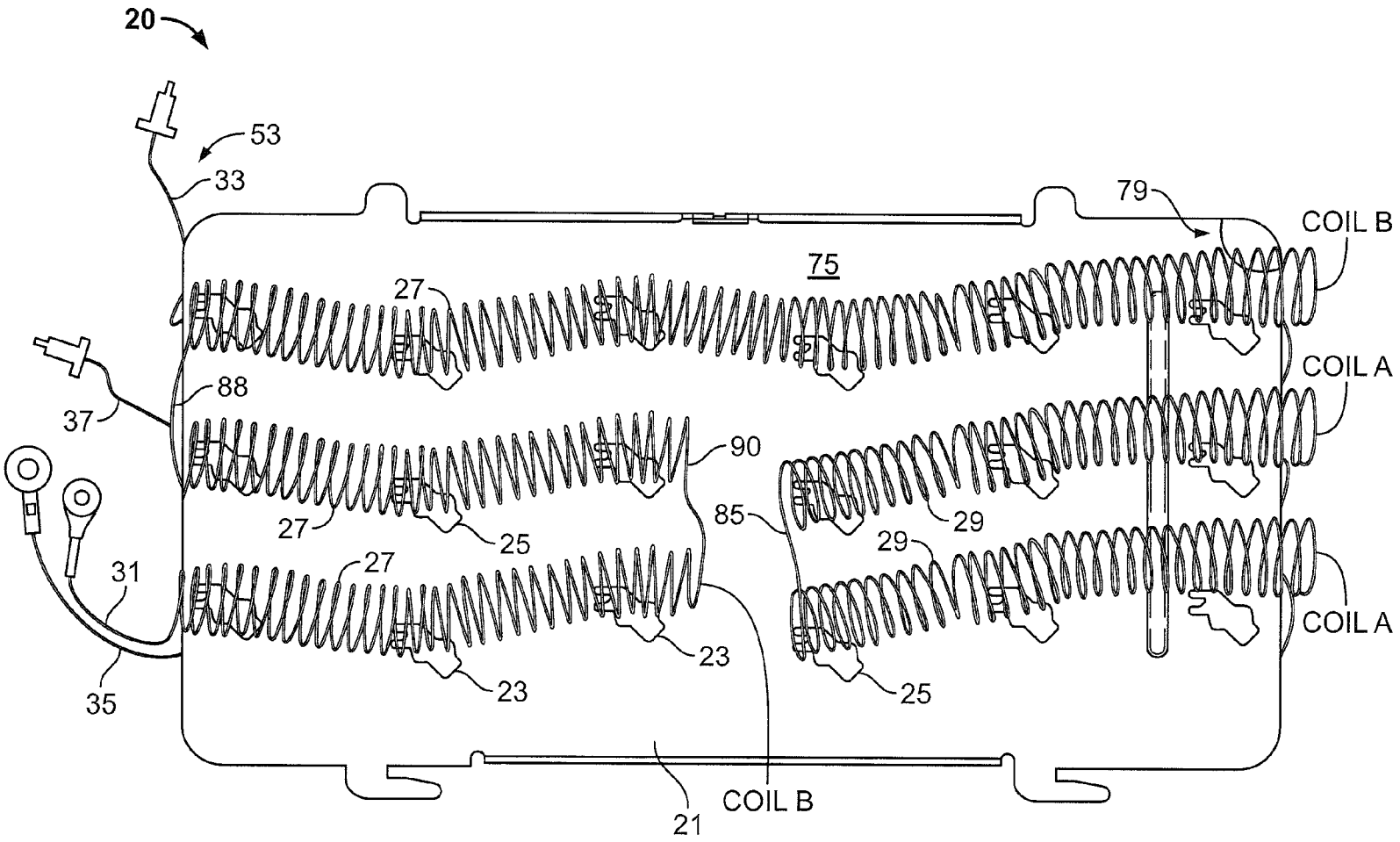
FIG. 2 (Prior Art)
FIG. 2 shows one side of an arrangement of the coils and terminations of a prior art electric heater.
Figure 3:
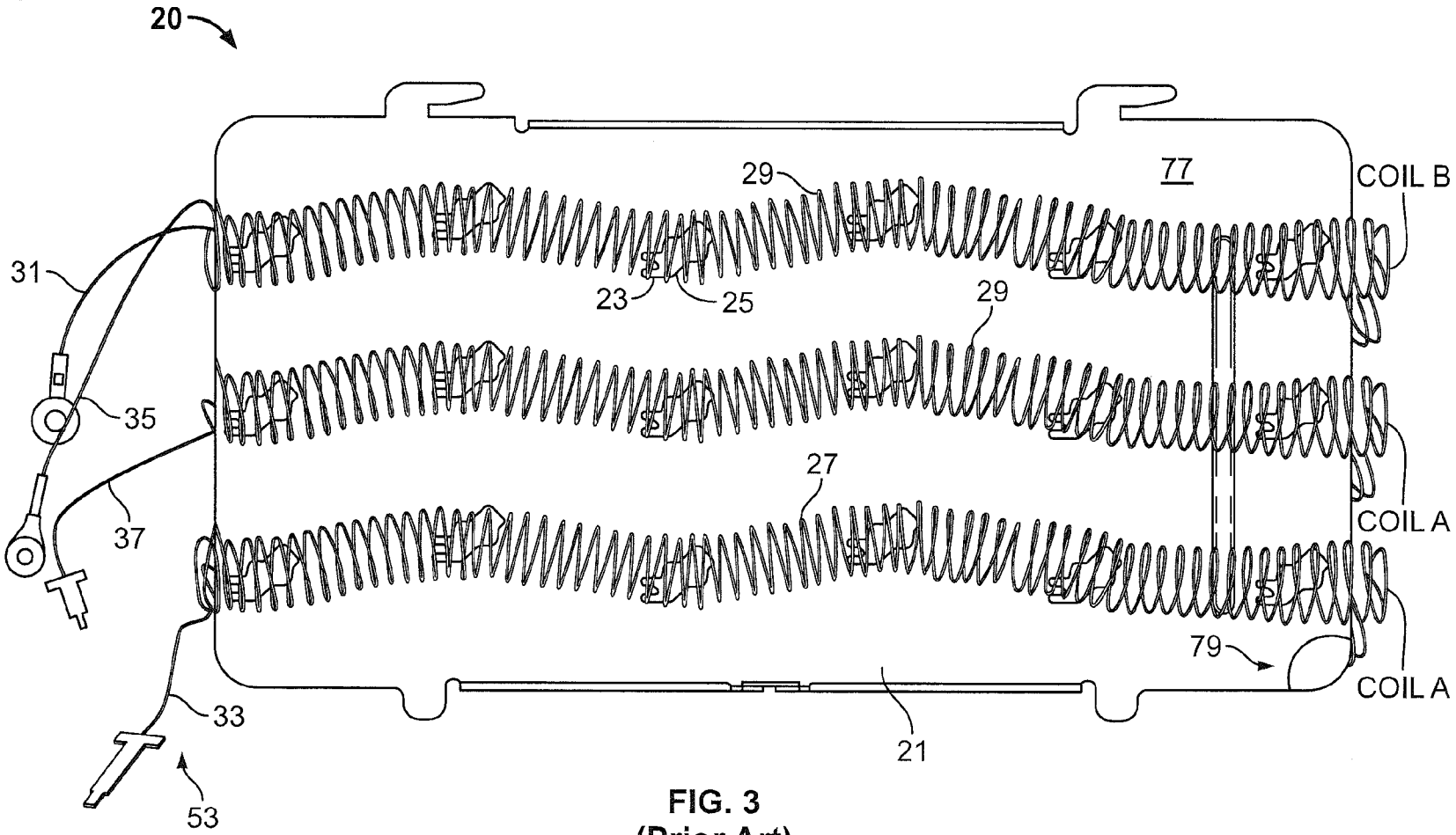
FIG. 3 (Prior Art)
FIG. 3 shows the bottom view of the other side of the arrangement of the coils and terminations of the electric heater of FIG. 2.
Figure 4:
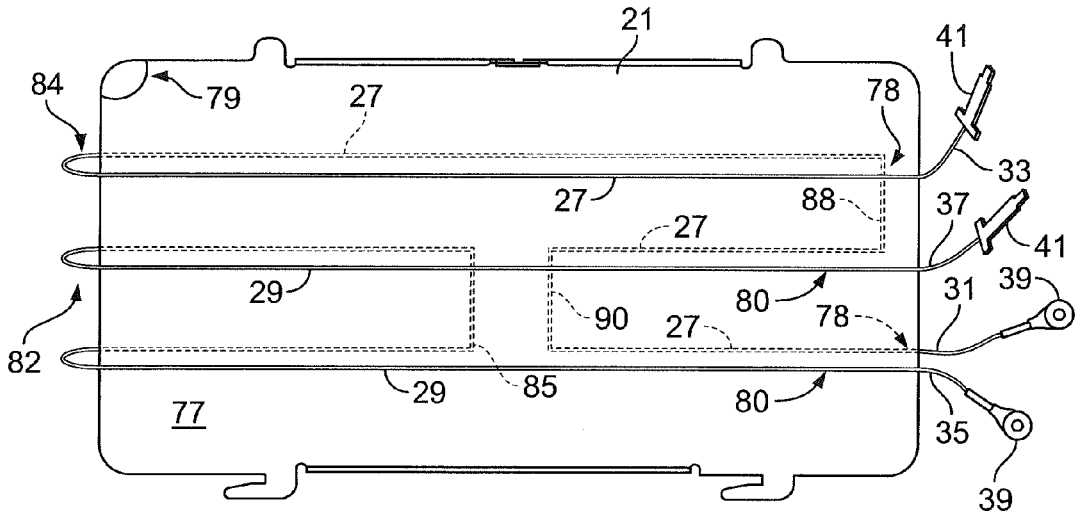
FIG. 4 (Prior Art)
FIG. 4 is schematic representation of the runs of the coils of the prior art electric heater depicted in FIGS. 2 and 3.
Figure 5:
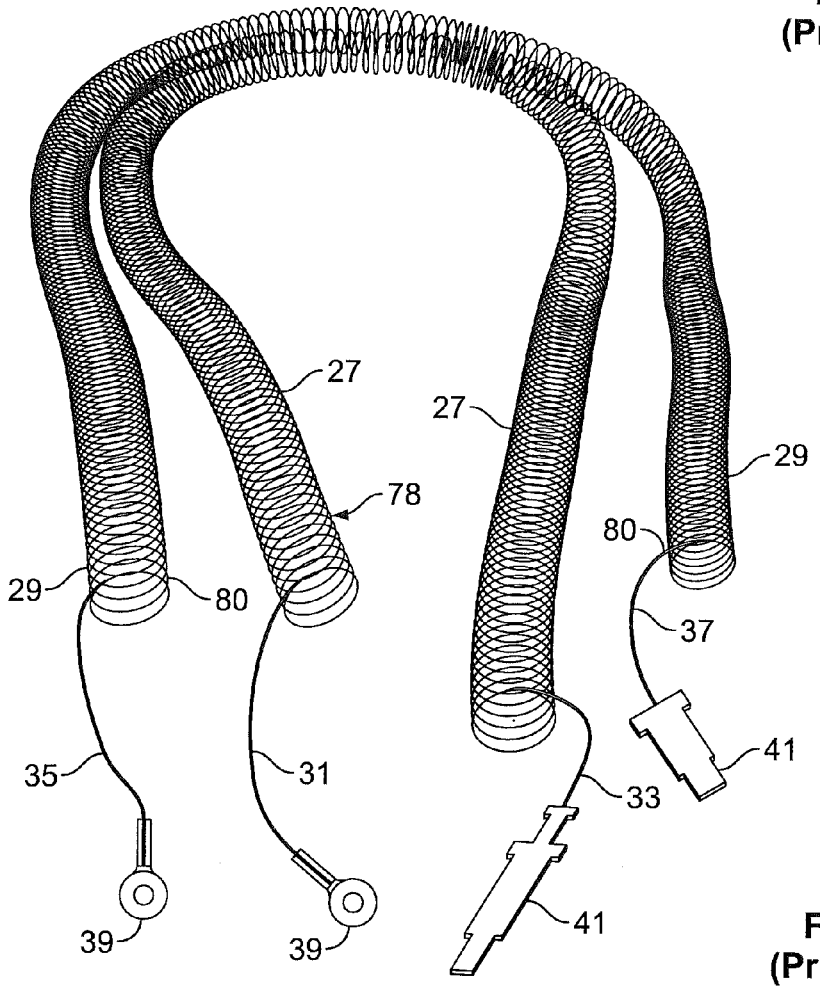
FIG. 5 (Prior Art)
FIG. 5 shows the coils and their terminations removed from the electric heater.
Figure 6:
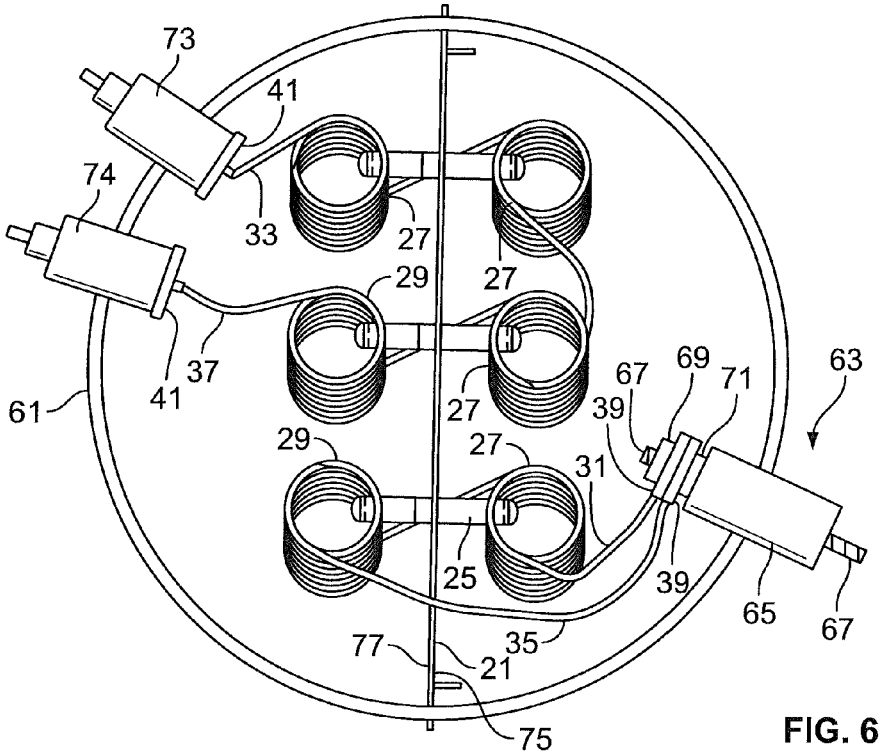
FIG. 6 (Prior Art)
FIG. 6 is an end view of a prior art electric heater, showing the heater duct, the heater support plate, the coils, and terminations of the coils.
Figure 7A:
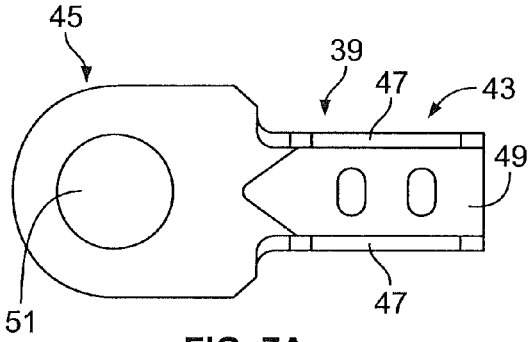
FIG. 7A (Prior Art)
FIGS. 7*a*-7C show a typical terminal for a heater coil.
Figure 7B:
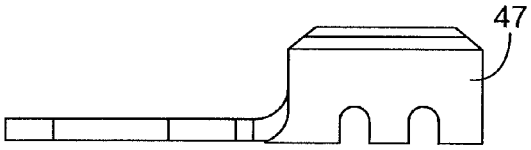
FIG. 7B (Prior Art)
Figure 7C:
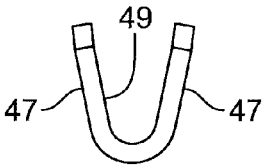
FIG. 7C (Prior Art)
Figure 8A:
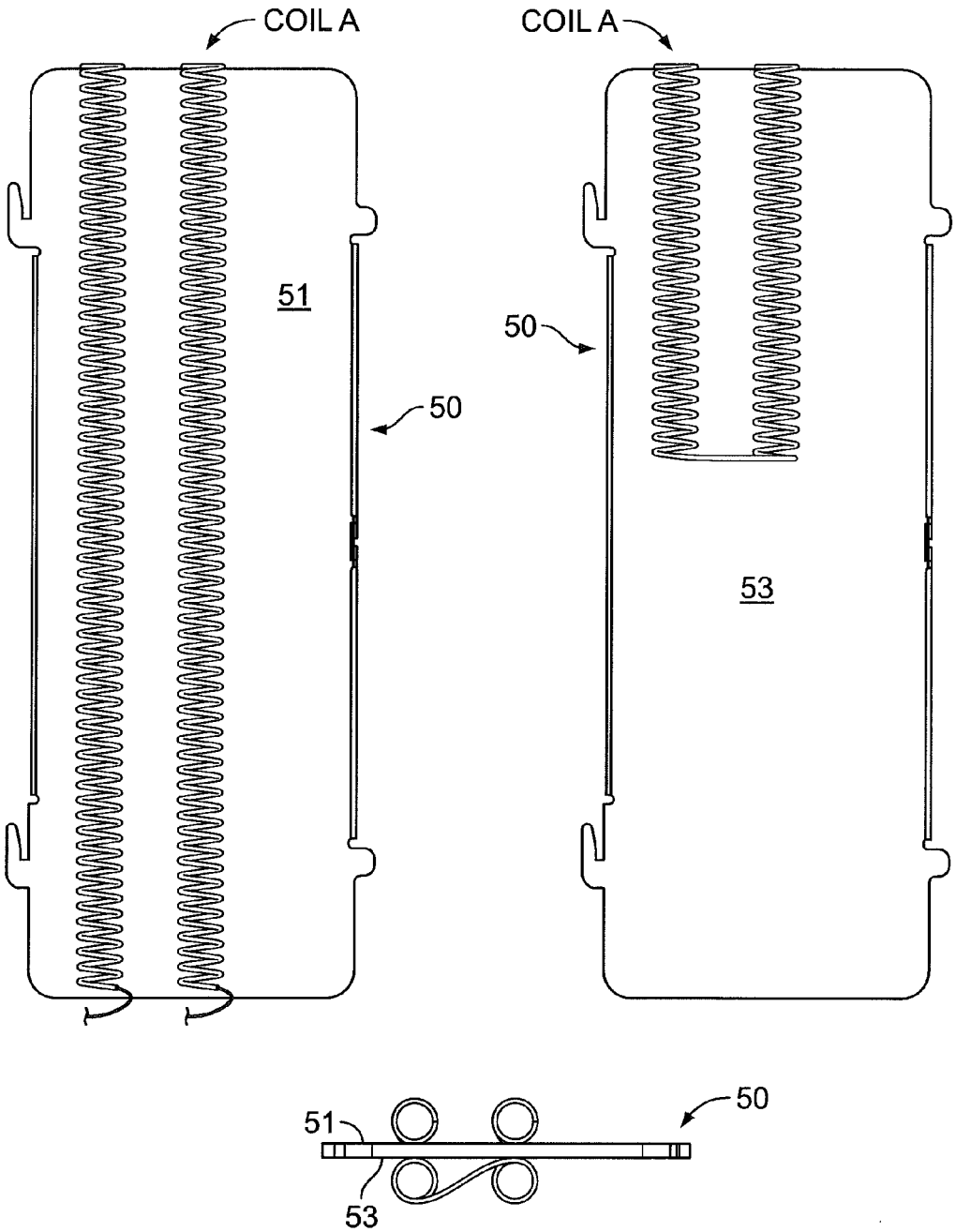
FIG. 8A (Prior Art)
FIG. 8A is a prior art schematic illustration showing the coil and power distribution between two sides of a heater support plate for one coil of a two coil heater.
Figure 8B:
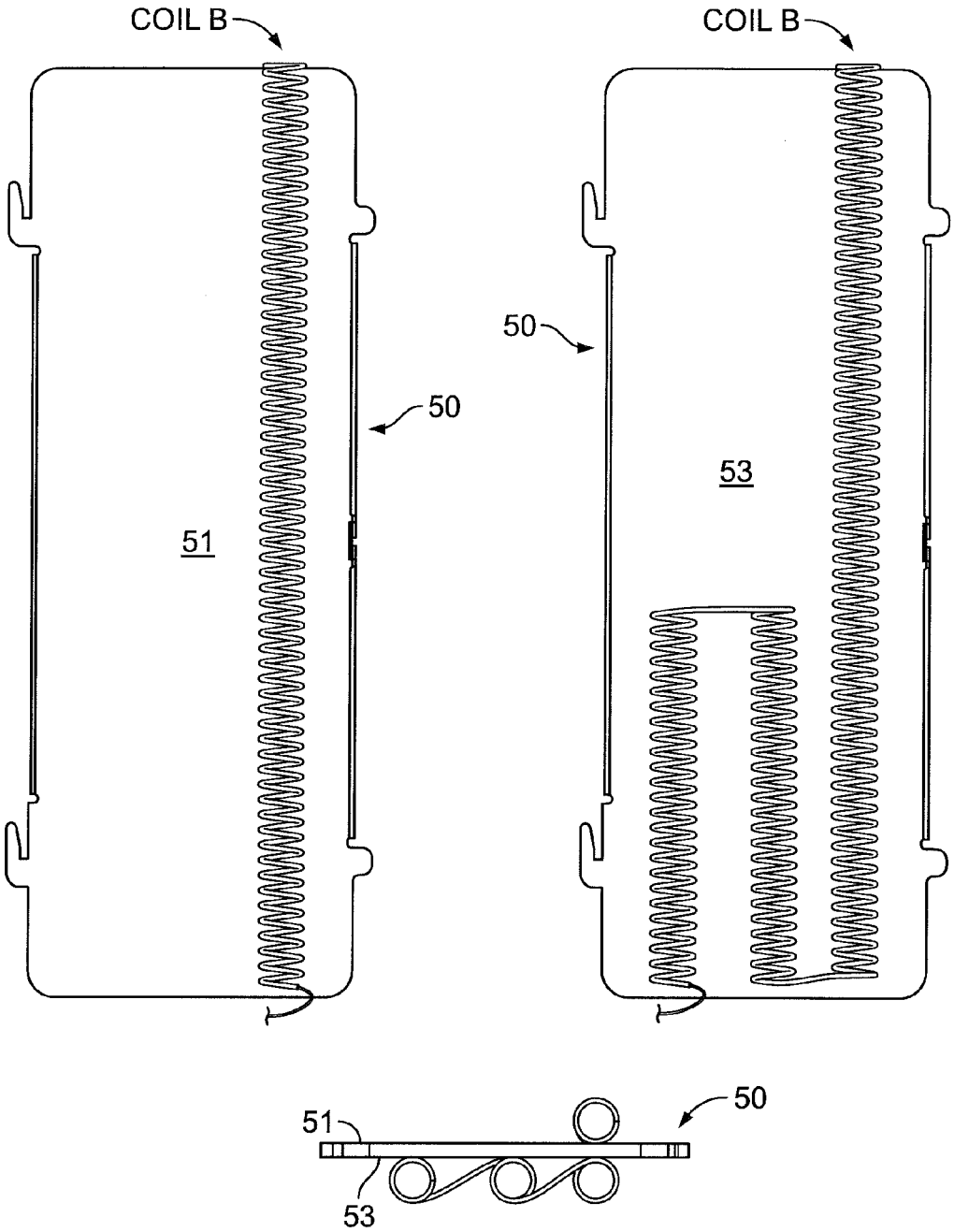
FIG. 8B (Prior Art)
FIG. 8B is a prior art schematic illustration showing the coil and power distribution between two sides of a heater support plate for the other coil in the heater of FIG. 8A.

Referring to FIGS. 8A and 8B, the coil configuration of each coil of the two coil heater shown in FIGS. 2 and 3 is illustrated. Referring to FIG. 8A, it can be seen that coil A has two thirds of its length above the heater plate 50 on side 51 and a third of its coil length below the heater plate on side 53. This means that the power is unevenly divided, with ⅔ power on the top and ⅓ power on the bottom. Also, it can be seen that across the width of the heater the coils are positioned with one run on the left side and one run down the middle of the heater. This means that the power distribution across the width of the heater is not uniform. More power is on the left side of the heater.

Referring to FIG. 8B, the other coil B in the heater of FIG. 2 is shown with its runs above and below the heater plate. Here, one third of the run of coil is on the top of the heater on side 51 and two thirds of the coil run are on the bottom of the heater or under the heater support plate on side 53. Thus, the power division is ⅓ power on top and ⅔ power on the bottom. Also, since three runs of coil are beneath the heater plate 50 and only one run of coil is on the top, the heat distribution of the coils is also uneven across the width of the heater. More heat will be generated on the right side of the heater.

Figure 9A:
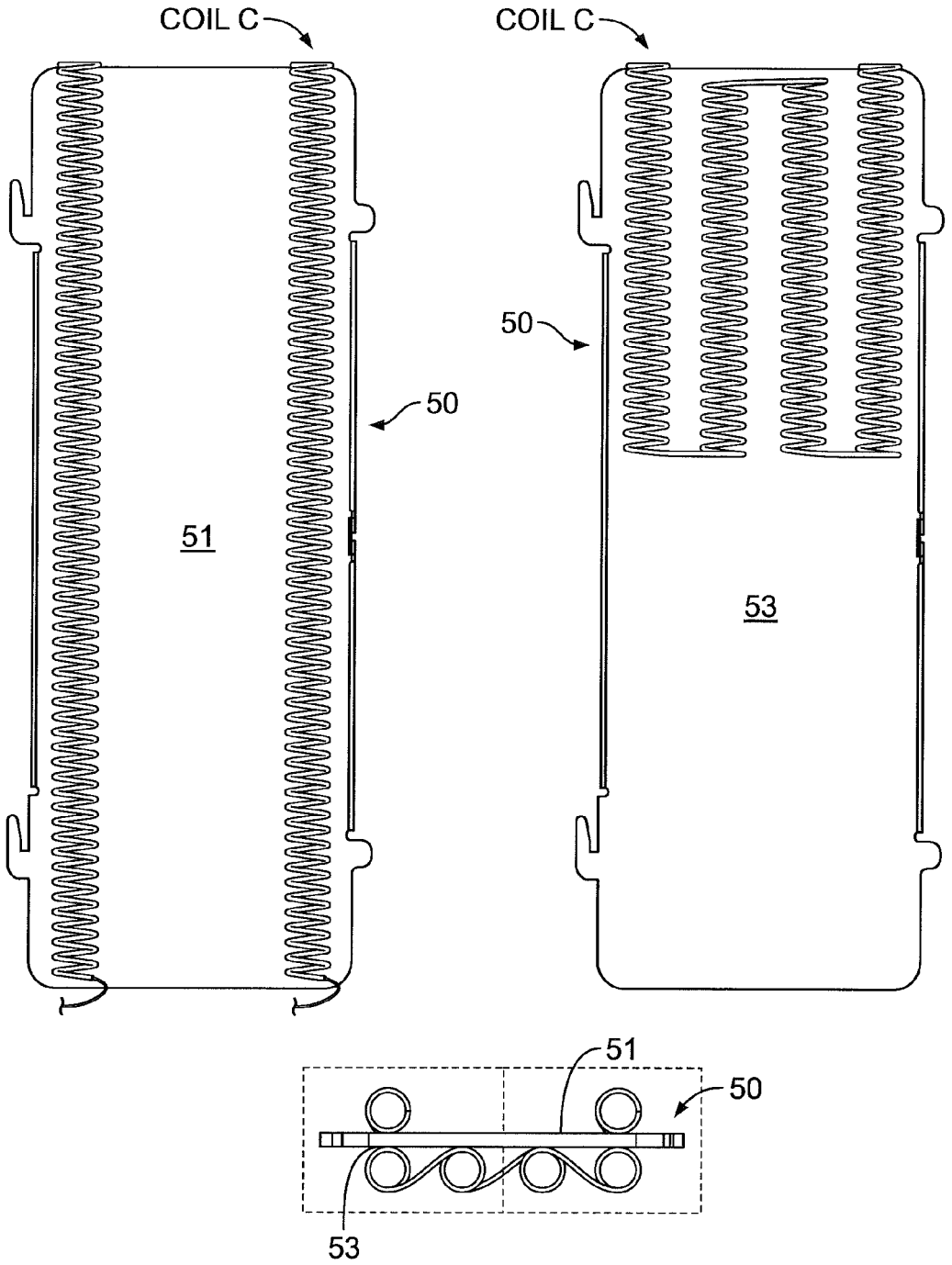
FIG. 9A is schematic illustration showing the coil and power distribution between two sides of a heater support plate for one coil of a heater according to the invention.
Figure 9B:
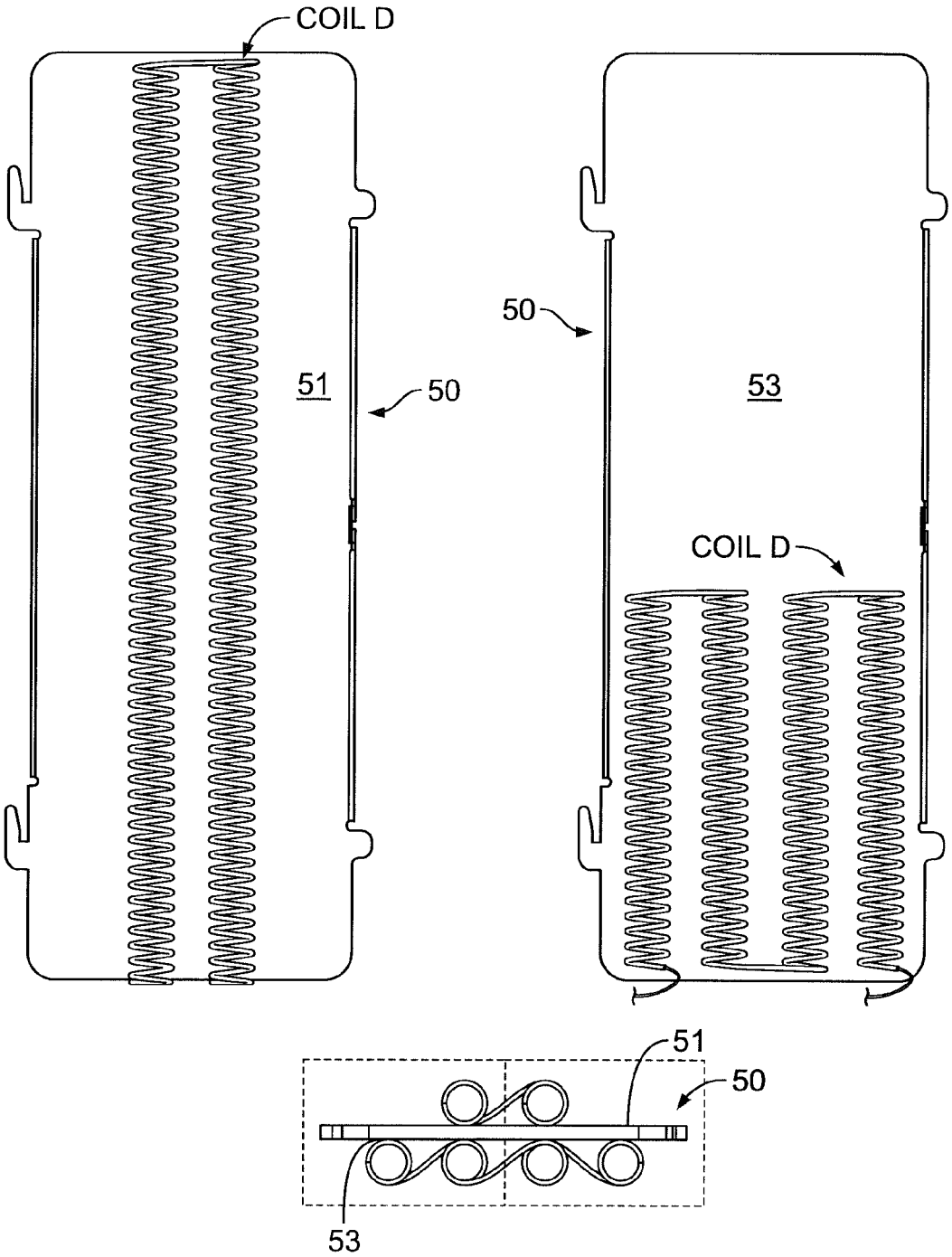
FIG. 9B is schematic illustration showing the coil and power distribution between two sides of a heater support plate for the other coil of a two coil heater according to the invention.

The invention provides an improved coil configuration over that shown in FIGS. 8A and 8B. Referring to FIGS. 9A and 9B, the inventive coil configuration is shown in terms of the runs of the coil. It should be understood that the insulators, heater housing, terminals etc. are not shown in these drawings since they are already disclosed in the prior art design of FIG. 2, which is applicable to the invention in terms of the ends of the actual coil portions of the coils being on the same side of the heater so that the electrical insulators used in the prior art heaters are avoided, termination of the coil ends can be more simply done. In fact, all features other than the coil configuration being improved upon that are shown in FIGS. 2-7*c* and described above can be applied to the invention.

The inventive coil configuration also employs two coils C and D. The configuration of the coil C is shown in FIG. 9A, and the configuration of Coil D is shown in FIG. 9B. Coil C shows that one half of the total coil length is on the side 51 of the heater support plate 50 with the other half of the total coil length being on the other side 53 of the heater support plate 50. With this configuration, it can be seen that the power for the coil is split evenly, ½ on the top of the heater and ½ on the bottom. When looking across the heater, it is also seen that ½ the coil length is on the left side of the heater with the other half of the coil length on the right side of the heater, see the end view of the coils in FIG. 9A. As such, the power is also divided evenly across the width of the heater.

The same configuration is shown for FIG. 9B. Coil D has ½ of its coil length above the support plate 50 on side 51 and the remaining half below the support plate 50 on side 53. In addition, ½ of the coil length is on the left side of the heater with the remaining half being on the right side, see the end view of the coils in FIG. 9B.

The inventive coil configuration has other advantages in terms of heater design. One typical problem with heater element design is radiant heat. Since radiant heat does not heat air directly, it can be considered a loss thereby reducing the efficiency of the air heating device. This can be considered from the standpoint of the element glowing, which heats the surrounding components but not the air.

In addition to this, the area normally available to locate heating elements is restricted, leaving the designer with the difficulty of trying to reduce radiant loss by using lower watt density elements. Reducing the watt density requires more wire length and thus linear stringing length. To account for these facts, designers have typically increased the element winding arbor (increase the diameter of the coil) in order to account for more wire length, thus reducing the watt loading. While these methods do allow for more length, they are limited in other design aspects since the increase in the coil diameter means that the coil is less rigid at high temperatures and thus less mechanically stable. This loss of rigidity and mechanical stability increases the chances for the coil to move during heater operation and cause a short to ground.

The inventive coil configuration overcomes this problem. That is, the coil assembly reduces the element outside diameter, which is opposite to the conventional approach used in the prior art, i.e., increase the coil diameter. This results in a diameter that allows the designer to increase the linear length available for element length (4 coils across the width and along the length of the support plate as opposed to the 3 coil configuration of FIGS. 2 and 3) and use a larger diameter wire (lower gauge). That is, with the prior art heater design, a 240 Volt 2500 watt heater would require 19 gauge wire of a certain length. With the inventive coil configuration, i.e., the element length increase, it further allows the designer to utilize more wire and heavier gauge wire, e.g., be able to use 18 gauge wire instead of the 19 gauge. This provides the ability to reduce the watt loading further than was possible in previous assemblies while making a more mechanically stable coil configuration due to the heavier gauge wire.

Another advantage for this new invention would be the fact that designs using the current (or prior art method) to even the heat distribution top to bottom and right side to left side, are forced to crossover the support plate on either the right or left side of the support plate. This type of crossover method can increase the probability of shorting to ground. This problem can often be a result of the fact these prior art techniques are more complex to produce and require that the element be formed very specifically. This, combined with the larger outside diameter elements being used, causes mechanical instability at high temperatures so as to allow the element to move more easily, increasing the likelihood of shorting to ground.

The inventive coil configuration utilizes smaller outside diameter elements with more mechanical stability at high temperatures, lower watt loading and more even heat distribution (including at least some distribution of heat "front to back"), thus reducing the likelihood of movement and reducing the likelihood of an element crossover causing a short to ground.

The coil configuration is also advantageous when a two stage coil heater is needed whereby the coils do not provide the same level of heating. For example, one coil could be rated at 30% power and the other coil could be rated at 70% power. This heater could be operated at 30%, 70%, or 100%, thus providing three different levels of heat generation. With the inventive uniform heat distribution between the top and bottom and left to right side, a more uniform heat distribution can be provided even when the coils are not identical.

Figure 10:
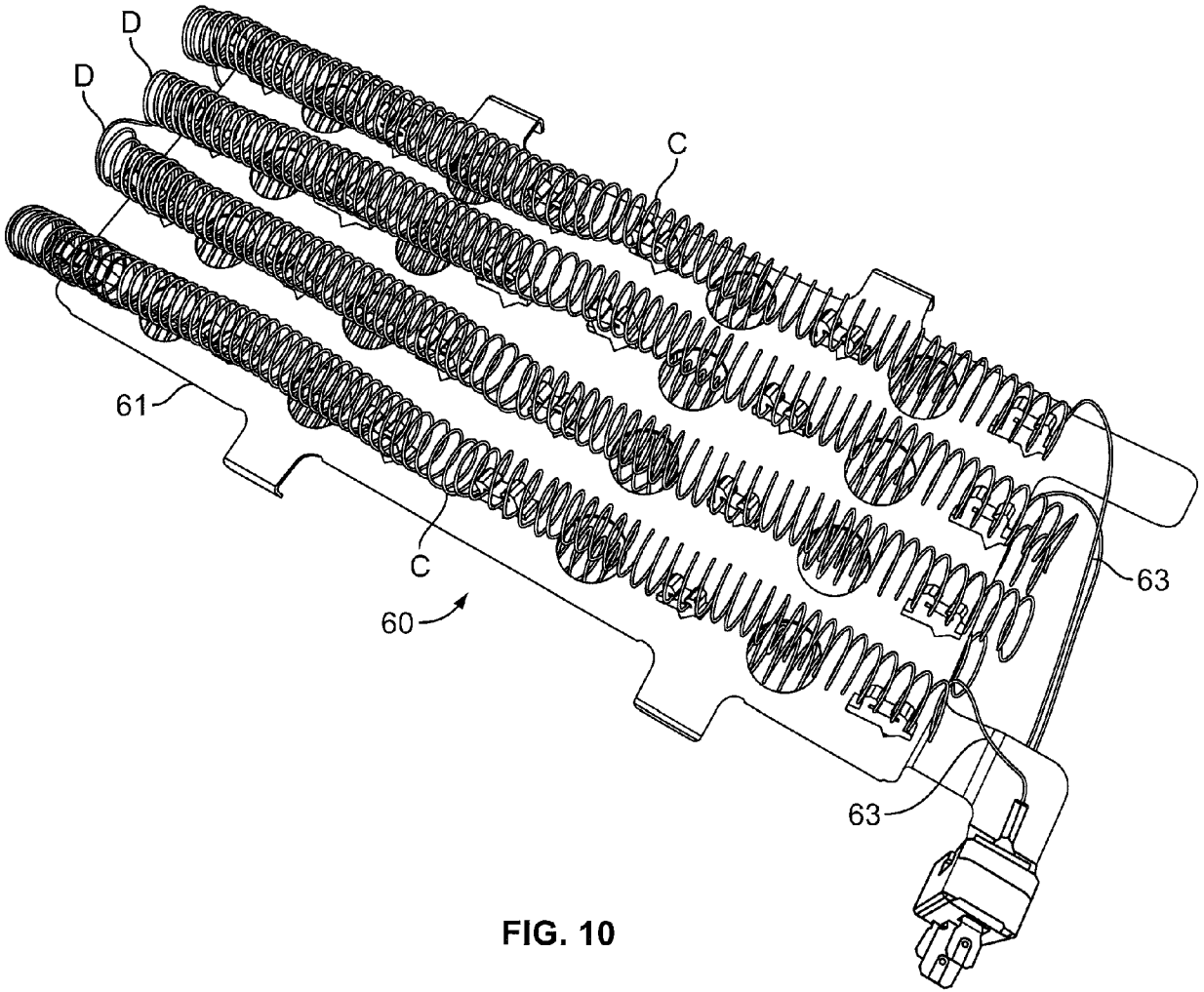
FIG. 10 is a perspective view of one side of a heater support plate showing the coils C and D of FIGS. 9A and 9B.

FIGS. 10-13 show perspective views of one embodiment of the inventive coil configuration. FIG. 10 shows a top view of the heater subassembly 60 with the long runs of each of coils C and D shown on one side of the support plate 61. Coil C on the outside and coil D arranged on the inside and inside of the two C coils. The leads 63 of coil C are shown as well. This view corresponds to the view of the top side 51 in FIGS. 9A and 9B.

Figure 11:
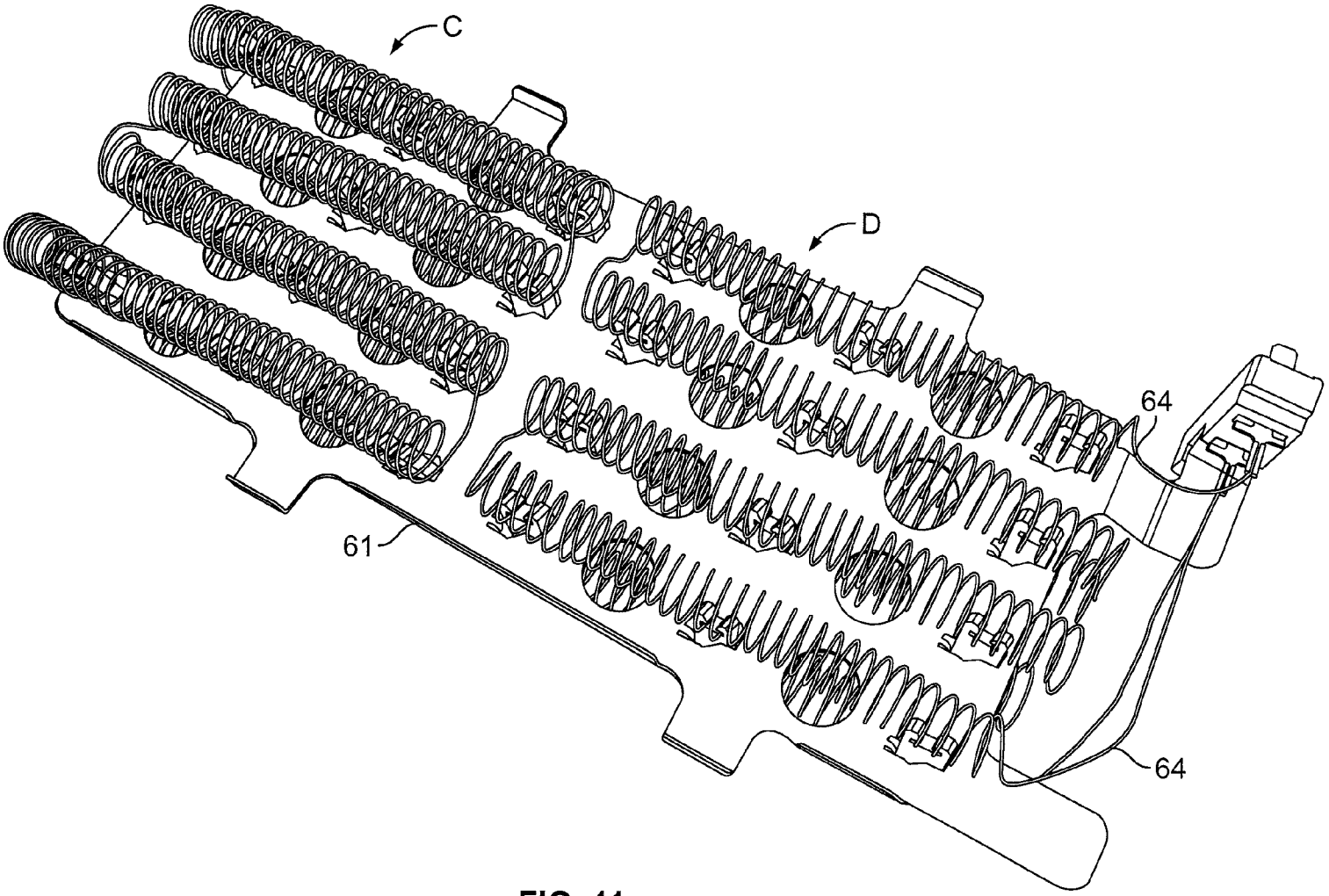
FIG. 11 is a perspective view of the other side of the heater support plate of FIG. 10 showing the coils C and D.

FIG. 11 shows the underside of the heater subassembly 60, wherein the coils C and D are formed with their respective runs extending over only roughly half the length of the heater plate. The leads 64 of coil D are also shown in FIG. 11.

As with the prior art configuration shown in FIG. 2, the coil ends of each of coils C and D are all at the end of the heater so that termination is very simple. This is evidenced by the fact that leads 63 and 64 are on the same end of the support plate 61.

Figure 12:
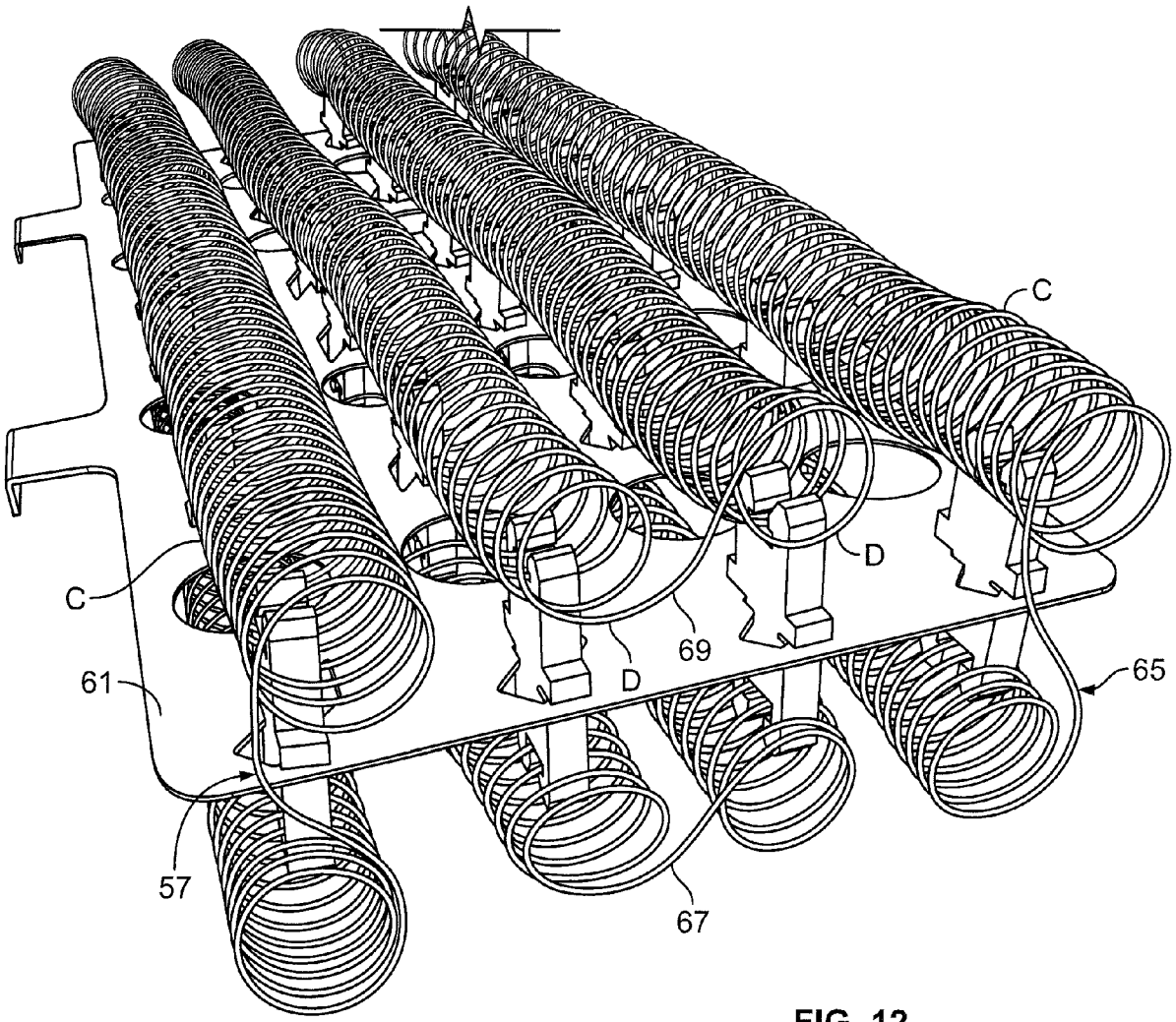
FIG. 12 is an end perspective view of the heater support plate of FIGS. 10 and 11.

FIG. 12 shows a better view of the crossover configuration at the end of the support plate 61. Coil C crosses over the support plate 61 at 65. While not shown, Coil D crosses over the support plate 61 at end opposite shown in FIG. 12.

The crossover between adjacent coil portions for coil C on the same side of the support plate is shown at 67 in FIG. 12. The crossover over of adjacent coil portions for coil D is shown as 69 in FIG. 12.

Figure 13:
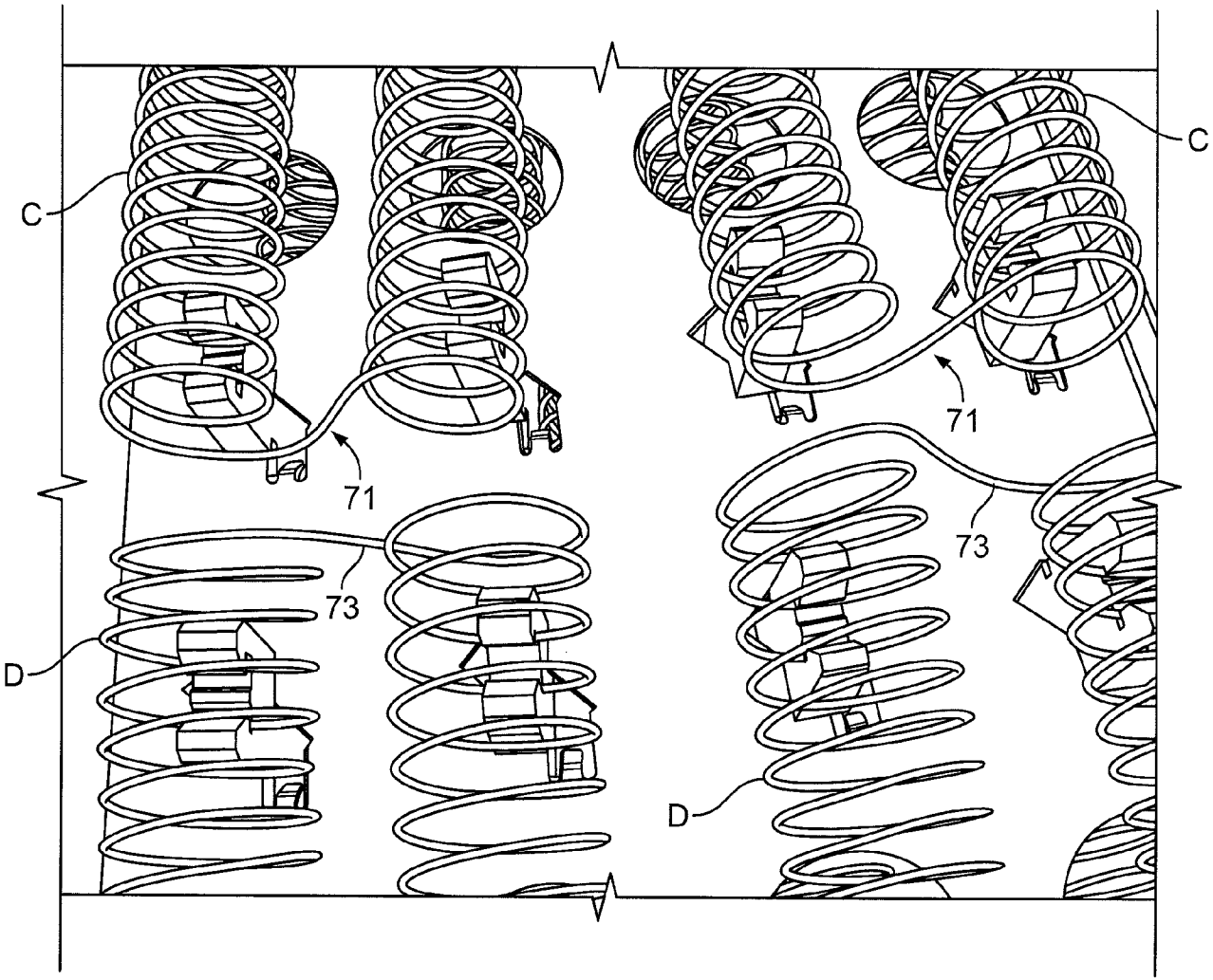
FIG. 13 is an enlarged view of the coil arrangement shown in FIG. 11.

Referring to FIG. 13, the crossover for the half length coils C and D on the same side of the support plate are shown in an enlarged fashion. The crossover for adjacent coil portions for coil C is shown at 71 and the crossover for the adjacent coil portions for coil D is shown at 73.

Even though the coils are shown in the drawings with the long runs on the top half of the heater plate, the long runs could be located on the underside of the heater plate with the half length runs on the top of the support plate.

As such, an invention has been disclosed in terms of preferred embodiments thereof which fulfills each and every one of the objects of the present invention as set forth above and provides a new and improved heater and method of use.

Of course, various changes, modifications and alterations from the teachings of the present invention may be contemplated by those skilled in the art without departing from the intended spirit and scope thereof. It is intended that the present invention only be limited by the terms of the appended claims.

The invention claimed is:

1. In an open coil electrical resistance heater subassembly having a support plate dividing the heater into at least two portions, at least two resistance wire coils, a plurality of insulators mounted to the support plate along a defined path, each insulator configured to provide support to a portion of the resistance wire coil, the at least two resistance wire coils partitioned generally equally on each side of the support plate, the at least two resistance wire coils each having first and second coil ends with a lead extending from each of the first and second coil ends, wherein each of the first and second coil ends are located at one end of the support plate, the improvement comprising the at least two resistance wire coils are arranged with respect to the support plate so that the coil power for each coil is distributed generally evenly between the top and bottom and across the width of the support plate.

2. The subassembly of claim 1, wherein each of the at least two resistance wire coils has a first terminal on one coil end and a second terminal on the other coil end, the first terminal further comprising a first end crimped to the one coil end and a second flat end with an opening sized to receive an elongated member of a terminal.

3. The subassembly of claim 1, wherein one of the at least two resistance wire coils has its coil ends arranged on one side of the support plate with the other of the at least two resistance wire coils having one coil end on one side of the support plate and the other coil end on the other side of the support plate.

4. The subassembly of claim 2, wherein one of the at least two resistance wire coils has its coil ends arranged on one side of the support plate with the other of the at least two resistance wire coils having one coil end on one side of the support plate and the other coil end on the other side of the support plate.

5. In a heater having a subassembly having a support plate dividing the heater into at least two portions, at least two resistance wire coils, a plurality of insulators mounted to the support plate along a defined path, each insulator configured to provide support to a portion of the resistance wire coil, wherein the support plate is mounted to a heater duct that surrounds the at least two resistance wire coils to form a passage for flow of air to be heated by the at least two resistance wire coils, the improvement comprising the subassembly being the subassembly of claim 1.

6. The heater of claim 5, wherein the heater duct has a power terminal mounted on one end thereof and at least one of the terminal ends is an elongated member extending from the power terminal, wherein each of the at least two resistance wire coils has a first terminal on one coil end and a second terminal on the other coil end, the first terminal further comprising a first end crimped to the one coil end and a second flat end with an opening sized receiving the elongated member of the power terminal for connection to power.

7. An open coil electrical resistance heater comprising:

a) a duct of defined cross section;

b) a support plate supported by the duct to divide the duct into two portions;

c) at least two resistance wire coils adapted to connect to a power source for energizing of the heater;

d) a plurality of insulators, each insulator mounted to the support plate to support portions of the resistance wire coils;

e) wherein the at least two resistance wire coils are partitioned generally equally on either side of the support plate, each of the resistance wire coils having first and second coil ends with a lead extending from each of the first and second coil ends, wherein each of the first and second coil ends are arranged at one end of the heater, and f) further wherein the at least two resistance wire coils are arranged with respect to the support plate so that the coil power for each coil is distributed generally evenly between the top and bottom and across the width of the support plate.

8. In a method of heating air using an open coil electrical resistance heater, the improvement comprising using the heater of claim 5.

9. The subassembly of claim 1, wherein each of the at least two electrical resistance coils have:

a) two runs, each of the two runs extending along a top surface of the support plate and generally the length of the support plate; and b) four runs, each of the four runs extending generally along a bottom surface of the support plate and generally about half the length of the support plate; or wherein the two runs are along the bottom surface and the four runs of each of the at least two electrical resistance wire coils are along the top surface.

10. The subassembly of claim 9, wherein crossovers for the two runs are at the ends of the support plate where the coil portions of at least two electrical resistance wire coils terminate and/or crossovers for the four runs are at a middle portion of the support plate.

11. The method of claim 8, wherein the heater further comprises:

a) a duct of defined cross section;

b) a support plate supported by the duct to divide the duct into two portions;

c) at least two resistance wire coils adapted to connect to a power source for energizing of the heater;

d) a plurality of insulators, each insulator mounted to the support plate to support portions of the resistance wire coils;

e) wherein the at least two resistance wire coils are partitioned generally equally on either side of the support plate, each of the resistance wire coils having first and second coil ends with a lead extending from each of the first and second coil ends, wherein each of the first and second coil ends are arranged at one end of the heater, and f) further wherein the at least two resistance wire coils are arranged with respect to the support plate so that the coil power for each coil is distributed generally evenly between the top and bottom and across the width of the support plate.

12. The heater of claim 5, wherein each of the at least two electrical resistance coils have:

a) two runs, each of the two runs extending along a top surface of the support plate and generally the length of the support plate; and b) four runs, each of the four runs extending generally along a bottom surface of the support plate and generally about half the length of the support plate; or wherein the two runs are along the bottom surface and the four runs of each of the at least two electrical resistance wire coils are along the top surface.

13. The heater of claim 12, wherein crossovers for the two runs are at the ends of the support plate where the coil portions of at least two electrical resistance wire coils terminate and/or crossovers for the four runs are at a middle portion of the support plate.

* * * * *